US007975952B2

(12) United States Patent
Gilbos et al.

(10) Patent No.: US 7,975,952 B2
(45) Date of Patent: Jul. 12, 2011

(54) WINDING STATION WITH MAGAZINE FOR EMPTY TUBES LOCATED UNDER THE WINDING MECHANISM

(75) Inventors: Erik Gilbos, Dikkelvenne (BE); Christian Van Hautte, Wannegem-Lede (BE); Emiel Rubbrecht, Iddergem (BE)

(73) Assignee: Textielmachinefabriek Gilbos N.V., Herdersem-Aalst (BE)

( * ) Notice: Subject to any disclaimer, the term of this patent is extended or adjusted under 35 U.S.C. 154(b) by 261 days.

(21) Appl. No.: 11/913,997

(22) PCT Filed: May 3, 2006

(86) PCT No.: PCT/EP2006/004102

§ 371 (c)(1), (2), (4) Date: Nov. 9, 2007

(87) PCT Pub. No.: WO2006/128541

PCT Pub. Date: Dec. 7, 2006

(65) Prior Publication Data

US 2008/0210805 A1 Sep. 4, 2008

(30) Foreign Application Priority Data

May 30, 2005 (EP) ..... 05447126

(51) Int. Cl.

| | |
|---|---|
| ***B65H 54/22*** | (2006.01) |
| ***B65H 54/71*** | (2006.01) |
| ***B65H 67/04*** | (2006.01) |
| ***B65H 67/08*** | (2006.01) |

(52) U.S. Cl. ..... 242/473.5

(58) Field of Classification Search ..... 242/473.4, 242/473.5, 473.8, 473.9, 474

See application file for complete search history.

(56) References Cited

U.S. PATENT DOCUMENTS 3,532,278 A 10/1970 Sparling (Continued)

FOREIGN PATENT DOCUMENTS

DE 1 291 662 3/1969

(Continued)

OTHER PUBLICATIONS

Machine Translation of DE-2503545.*

(Continued)

*Primary Examiner* — William E Dondero

(74) *Attorney, Agent, or Firm* — Knobbe Martens Olson & Bear LLP

(57) ABSTRACT

A winding station for winding textile yarn onto empty tubes is disclosed. The winding station includes a winding mechanism (1) with two flanges (2) for gripping the ends of the tube (8). Each flange is mounted on a pivoted winding arm (6). These arms position the empty tube (8) in contact with a driving roller (14) so that the longitudinal axis of the empty tube (8) is above the longitudinal axis of the driving roller (14). A stationary, linear magazine (4) with a filling end (5) and a feeding end (7) is included. The filling end (5) and the feeding end (7) of the magazine (4) are inclined at angle, alpha, of less than or equal to 45°, to the driving roller (14). A lifting mechanism (11) includes a pivoted arm (9) terminating in a tube carrier (10). The tube carrier (10) is configured to bring an empty tube from the feeding end (7) of the magazine (4) to a space between the flanges (2) by an arc movement of the arm (9). A winding assembly and method are also disclosed.

14 Claims, 4 Drawing Sheets

U.S. PATENT DOCUMENTS

| | | | | |
|---|---|---|---|---|
| 3,801,030 | A | 4/1974 | Kobatake et al. | |
| 3,901,456 | A | 8/1975 | Pradier | |
| 3,948,452 | A * | 4/1976 | Burysek et al. | 242/473.8 |
| 4,154,411 | A | 5/1979 | Kamp et al. | |
| 5,937,629 | A | 8/1999 | Spindler et al. | |
| 2003/0038206 | A1 * | 2/2003 | Grecksch et al. | 242/475.6 |

FOREIGN PATENT DOCUMENTS

| | | |
|---|---|---|
| DE | 25 03 545 | 8/1976 |
| DE | 29 15 533 | 10/1979 |
| DE | 44 42 304 | 6/1995 |
| EP | 0 839 748 | 5/1998 |
| EP | 0 839 748 A3 | 7/1998 |
| FR | 875677 | 9/1942 |
| GB | 12182 | 2/1912 |
| GB | 2112031 | 7/1983 |
| JP | 51 043448 | 4/1976 |
| JP | 51 084943 | 7/1976 |

OTHER PUBLICATIONS

Machine Translation of FR-875677.*
International Search Report dated Aug. 4, 2006.

* cited by examiner

WINDING STATION WITH MAGAZINE FOR EMPTY TUBES LOCATED UNDER THE WINDING MECHANISM

CROSS-REFERENCE TO RELATED APPLICATIONS

This application is the U.S. National Phase under 35 U.S.C. §371 of International Application PCT/EP2006/004102, filed May 3, 2006, which claims priority to EP 05447126.3, filed May 30, 2005.

FIELD OF THE INVENTION

The present invention relates to a winding station for textile yarn comprising a winding mechanism and a magazine for holding empty tubes, wherein the feeding end of said magazine is located below and very close to the winding mechanism.

BACKGROUND TO THE INVENTION

Package winding stations of the art commonly have a magazine for empty tubes that is located at a rather long distance from the winding station, in order that the magazine does not interfere with the package being wound, nor prevent access to the winding station, for example, by operators or technicians.

Winding stations are variously described in the art, for example, in FR 875 677, DE 2503 545, GB 12182, DE 29 15 533, U.S. Pat. No. 4,154,411, DE 12 91 662, JP 51 08494 3, U.S. Pat. No. 3,901,456, JP 51 043448.

Replacing a full package with an empty tube in such winding stations, therefore, requires large, inherently unsafe and time-consuming movements of the empty tube or the cradle arms, or complex and expensive devices to overcome said disadvantages.

Such winding stations are unsuitable for use where the available space is limited, but or where safe and ergonomic access by the operators or technicians is required, for example for starting up, making corrective actions, repairs and adjustments.

Furthermore, a store of empty tubes placed above the winding mechanism is not an ergonomic arrangement for an operator of the station. If an empty tube is jammed, care must be taken not to release the store of empty tubes which would otherwise fall onto the winding mechanism or the operator, causing damage. Also, by feeding under the influence of gravity, a special mechanism must be employed to prevent the tube dispensed from the magazine falling down on the winding mechanism.

It is an aim of the present invention to provide a simple winding station that overcomes the problems of the prior art.

SUMMARY OF SOME EMBODIMENTS OF THE INVENTION

One embodiment of the present invention is a winding station for winding textile yarn onto empty tubes, comprising:

- a winding mechanism 1 comprising two flanges 2 for gripping the ends of said tube 8, each flange mounted on a pivoted winding arm 6, which arms position the empty tube 8 in contact with a driving roller 14, such that the longitudinal axis of the empty tube 8 is above the longitudinal axis of the driving roller 14,
- a stationary, linear magazine 4 with a filling end 5 and a feeding end 7, wherein
  - the filling end 5 and the feeding end 7 of the magazine 4 are below the level of the flanges 2, and
  - the filling end 5 is above feeding end 7 such that magazine 4 is inclined at angle, alpha, of less than or equal to 45 deg,
- a lifting mechanism 11 comprising a pivoted arm 9 terminating in a tube carrier 10, which tube carrier 10 is configured to bring an empty tube from the feeding end 7 of the magazine 4 to a space between the flanges 2 by an arc movement of the arm 9.

Another embodiment of the present invention is a winding station as described above, wherein the lifting mechanism 11 is configured to bring an empty tube from the feeding end 7 of the magazine 4 to a space between the flanges 2 by an arc movement of the arm 9, when said flanges 2 are in a doffing position.

Another embodiment of the present invention is a winding station as described above, wherein the lifting mechanism is configured to return the tube carrier 10 to the feeding end of the magazine 4 after the flanges 2 have gripped the empty tube 8.

Another embodiment of the present invention is a winding station as described above, wherein said winding arms are configured to move in a direction away from the filling end 5 of the magazine 4 to eject the completed package, so providing a linear workflow from the front to the back of the station.

Another embodiment of the present invention is a winding station as described above, wherein the point of the pivot 25 of the winding arms 6 is below the longitudinal axis 3 between the flanges 2.

Another embodiment of the present invention is a winding station as described above, wherein the feeding end 7 of the magazine 4 is located close below the flanges 2, so that a movement—which distance is less than or equal to 3 times the outside diameter of an empty tube—by the tube carrier 10 lifts an empty tube 8 from a ready position 13 at the mouth of the magazine to the space between the flanges 2 when the winding arms are in a doffing position.

One embodiment of the present invention is a winding station for winding textile yarn onto empty tubes, comprising a winding mechanism 1 and a magazine 4 for feeding empty tubes, wherein the feeding end of said magazine is located below and very close to the winding mechanism.

Another embodiment of the present invention is a winding station as described above wherein said winding mechanism comprises two flanges 2 capable of contacting the ends of the longitudinal axis of said empty tube.

Another embodiment of the present invention is a winding station as described above further comprising a lifting mechanism 11 with a device that transfers an empty tube dispensed from the feeding end 7 of the magazine to the space between the flanges 2 of the winding mechanism 1.

Another embodiment of the present invention is a winding station as described above wherein said device is a tube carrier 10 which lifts the empty tube 8 from below.

Another embodiment of the present invention is a winding station as described above wherein said lifting mechanism 11 moves the empty tube in an arc which crosses the longitudinal axis of the flanges and the centre of the empty tube dispensed from the feeding end 7 of the magazine.

Another embodiment of the present invention is a winding station as described above wherein the lifting mechanism 11 further comprises an arm or tube support extender or reducer 12 to fine-adjust the position of the lifted empty tube between the flanges 2.

Another embodiment of the present invention is a winding station as described above wherein the magazine 4 is inclined at an angle, such that the feeding end 7 is lower than the filling end 5.

Another embodiment of the present invention is a winding station as described above wherein the tube carrier is disposed with one or more cutting mechanisms for cutting the supply of yarn from the fully wound package when the tube carrier is moving towards or located at the flanges.

Another embodiment of the present invention is a winding station as described above wherein said cutting mechanism is positioned on the tube carrier so it is aligned proximal to one or both ends of the lifted empty package.

Another embodiment of the present invention is a winding station as described above wherein the longitudinal axis of an empty tube dispensed from the feeding end of a magazine and the longitudinal axis 3 between the flanges 2 are parallel.

Another embodiment of the present invention is a winding station as described above further comprising a vacuum enclosure that is at least partially enclosing the fed yarn during winding.

Another embodiment of the present invention is a winding assembly comprising two or more winding stations as described above.

Another embodiment of the present invention is a winding assembly as described above wherein said stations are arrange side by side in the direction of the longitudinal axes of the empty tube.

Another embodiment of the present invention is a winding assembly as described above wherein one or more components having longitudinal axes are interconnected between two or more winding stations.

Another embodiment of the present invention is a winding assembly as described above wherein said stations are arranged vertically.

Another embodiment of the present invention is a device to capture the trailing end of a package on a winding machine comprising:

- a vacuum enclosure 15 shaped to enclose the yarn across the range of its movements, while remaining stationary,
- a slot 20 suitably configured for the passage of yarn to a package,
- one or more tubes 19 connected to the nozzle configured to direct yarn from the yarn supply to the wound package or vice versa, and for the application of suction to the vacuum enclosure 15.

Another embodiment of the present invention is a method for winding empty tubes stored in a magazine using a winding mechanism comprising:

- lifting an empty tube from the feeding end of the magazine to the winding mechanism, said movement being in an upward direction,
- winding yarn on the tube from a supply of yarn, and
- removing the wound package.

DETAILED DESCRIPTION OF THE INVENTION

Figure 1:
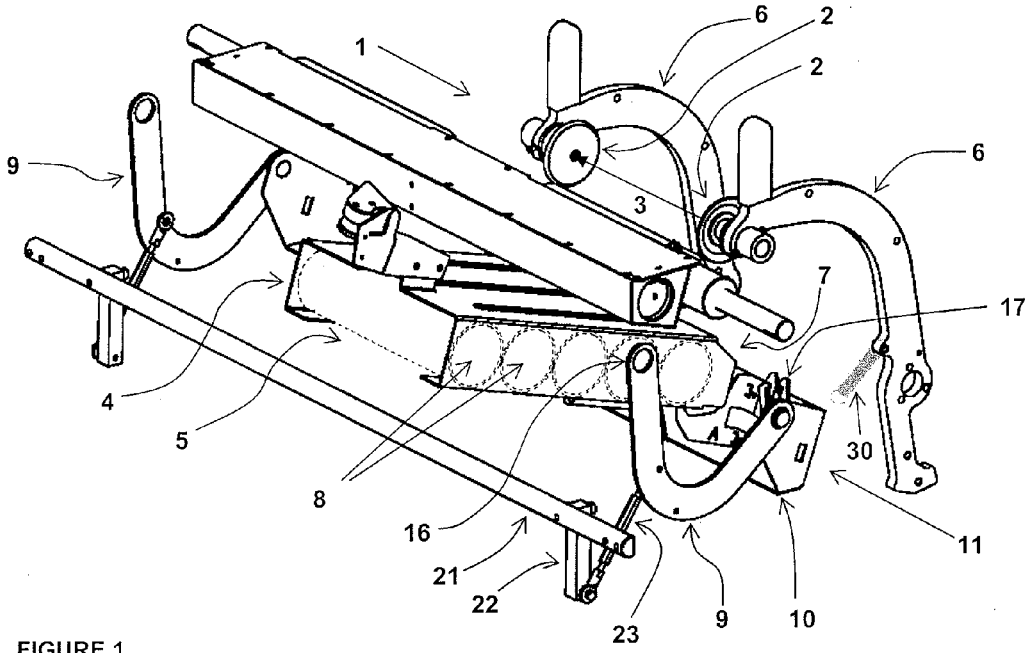
FIG. 1: Schematic figure of a winding station according to the present invention, where the winding mechanism is in a winding position.

The present invention relates to a winding station for textile yarn comprising a winding mechanism and a magazine for feeding empty tubes, wherein the feeding end of said magazine is located below and very close to the winding mechanism.

The articles "a" and "an" are used herein to refer to one or to more than one, i.e. to at least one, the grammatical object of the article. By way of example, "winding station" means one winding station or more than one winding station.

Reference is made to the Figures in the description below. It is the intention to clarify the description by reference to the drawings, however, it is by no means meant to limit the invention to the single embodiment of the Figures.

A winding station of the present invention comprises a winding mechanism 1 having suitable means for holding, winding and releasing a tube 8 and winding yarn onto said tube. The means for holding, winding and releasing a tube can be any, but preferably comprises two flanges 2 which are capable of contacting the ends of the longitudinal axis of said tube. The flanges can grip and release a tube and also permit rotation thereof during winding. The flange are preferably circular shaped and can engage with the ends of an empty tube 8. The distance between the two flanges 2 can be adjusted to accommodate different sizes of tubes. The longitudinal axis 3 between the flanges 2 can have any angle, depending on the shape of the empty tube 8. The Figures show an embodiment for cylindrical tubes.

According to an aspect of the invention, the flanges 2 are mounted on pivoted arms 6 (winding arms) allowing said flanges to move towards or away from a rotating roller (driving roller 14). The winding arms 6 preferably position the empty tube 8 in contact with the driving roller 14, such that the longitudinal axis 3 between the flanges 2 is above the longitudinal axis of the driving roller 14. The point of the pivot 25 is preferably below the longitudinal axis of the space between the flanges 3. As the driving roller rotates, so the tube 8 rotates and winding is effected by virtue of a frictional contact. The winding arms 6 are preferably pivoted so that as yarn is wound on the tube 8 and the package so formed increases in diameter, the winding arms 6 are pushed further away from the driving roller 14. The path of feeding yarn 28 lies across the top of the magazine, and may be inclined with respect to the horizon at the same angle as the magazine.

By positioning the longitudinal axis of the empty tube 8 above the longitudinal axis of the driving roller 14, sufficient pressure between tube 8 and driving roller 14 for winding can be provided by the force of gravity, optionally complemented by the force of a light spring 30. Such pivoted winding arms 6 thus greatly simplify the design of the machine by obviating the need for a powered mechanism (e.g. hydraulic, motorised) to retain the empty tube in contact with the driving roller 14. Furthermore, the pressure applied is light, so as not to deform the package. After winding is completed, the pivoted winding arms 6 may move backwards, away from the winding mechanism to eject the package (i.e. move into a doffing position), said package being ejected in a direction behind the winding station.

Thus, the machine may be loaded from the front and full packages are ejected from the back; such linear workflow of the design allows clearly defined operational areas in a factory, such as a dedicated loading bay for empty tubes, and area for collecting packages. This has advantages over machines of the art where loading and collecting take place in the same area, leading to a congested and less efficient work space.

A winding station of the present invention further comprises a magazine 4 suitable for feeding empty tubes 8 to the winding mechanism. The magazine is linear. This means that the empty tubes lie on a flat surface inside the magazine. The empty tubes may be stored in the magazine so that the transverse cross-sectional midpoint 27 of each tube forms an imaginary straight line along the length of the magazine. The feeding end of the magazine 7, i.e. the end which dispenses empty tubes to the winding mechanism is located below and very close to the winding mechanism. Preferably, the feeding end of the magazine is at the minimum distance from the winding mechanism, which other components such as the driving roller 14, or yarn traverse guide permit.

According to one aspect of the invention, the feeding end of the magazine is located close below the winding mechanism, so that a movement of less than or equal to 60, 55, 50, 45, 40, 35, 30, 35, 30, 25, 20, 15, 10 degrees by the tube carrier, lifts an empty tube from the ready position 13 at the mouth of the magazine to the space between the flanges 2 preferably when the winding arms are in the doffing position (i.e. the position of the winding arms when a full package is ejected and a new empty tube is brought into the space between the flanges). The movement is preferably an arc 18 which crosses the centre of the empty tube in the ready position 13 and the longitudinal axis of the flanges 2 preferably in the doffing position. Preferably the radius of the arc is 230 mm and the centre of the arc is located 143.5 mm from the centre of the driving roller 14.

According to another aspect of the invention, the feeding end of the magazine is located very close below the winding mechanism, so that a movement—which distance is less than or equal to 4, 3, 2.5, 2, 1.5 times the outside diameter of an empty tube—by the tube carrier lifts an empty tube from the ready position 13 to the space between the flanges 2 when the winding arms are in the doffing position i.e. the position of the winding arms arm when a full package is ejected and a new empty tube is brought into the space between the flanges. In other words the distance between (1) the centre of the tube in the tube carrier (described below) in the ready position and (2) the centre flanges in the doffing position is less than or equal to 4, 3, 2.5, 2, 1.5 times the outside diameter of an empty tube.

Empty tubes are fed towards the feeding end by any means such as for example, gravity, a spring mechanism, roller system or piston mechanism. Preferably, the magazine is fixed (stationary) and inclined at an angle which feeding end 7 is lower than the filling end 5. In this configuration, the empty tubes are fed towards the feeding end 7 by gravity. An additional device may prevent the empty tubes from moving when the tube carrier 10 of the lifting mechanism 11 is not in its lower resting position. Alternatively, the tube carrier may move rapidly enough between operations to catch the empty tube as it falls from the magazine. The use of gravity means the construction and running costs are lower, since powered feeding device and components associated therewith are not needed. Furthermore, gravity feed applies a minimal pressure to the tubes so the tubes do not become locked or snagged in the magazine.

According to one aspect of the invention, both the feeding end 7 and filling end 5 of the magazine are located below the level of the winding mechanism, and the magazine is fixed and inclined at an angle (alpha) which feeding end 7 is lower than the filling end 5. Angle alpha is sufficient to allow feeding of empty tubes to a tube carrier described below using gravity. Angle alpha may adopt an angle equal to or less than 1, 2, 3, 4, 5, 6, 7, 8, 9, 10, 11, 12, 13, 14, 15, 16, 17, 18, 19, 20, 21, 22, 23, 24, 25, 26, 27, 29, 30, 31, 32, 33, 34, 35, 36, 37, 38, 39, 40, 41, 42, 43, 44, 45 deg, or a value in the range between any two of the aforementioned values. The angles are preferably compared with the horizon. Preferably alpha is a value in the range between 10 and 15 deg, most preferably around 12 deg. By locating the magazine entirely below the winding mechanism, access to the winding mechanism is not obstructed by the magazine so enabling easy maintenance and fast correction of any interruptions caused by tangle or blockages in the winding mechanism.

Because the magazine is positioned below and very close to the winding mechanism, when multiple winding stations are stacked in a vertical direction, the resulting assembly is more symmetrical in the vertical direction than machines of the prior art. This allows a simpler and cheaper construction of the supporting frame and improves the operators' overview on the process.

The storage of empty tubes below the winding mechanism provides easy and safe access by the operator. There is no danger of falling empty tubes and the height of access is ergonomically more favourable, unlike winding stations of the prior art where tubes are stored above the winding mechanism. Thus the risk of injury or strain is thus reduced by the present arrangement.

When multiple winding stations are stacked in a vertical direction, the height of the total assembly is very important. For this reason, the vertical distance between the stacked winding stations is normally based on the maximum diameter of the packages to be produced with such a winding station. Because the magazine is positioned below and very close to the winding mechanism in the present invention, the construction of the winding station itself is not influenced by the chosen maximum package diameter and allows more flexibility in vertically stacking the winding stations, optimising accessibility and ergonomics.

An empty tube is held in a ready position 13 below the winding mechanism 1 until it is to be lifted towards the winding mechanism. It may be held in a ready position 13 by any means such as a suitably positioned stop in the magazine or a stop present in the body of the winding station, or a tube carrier 10 described below. The ready position may coincide essentially with the position of an empty tube 8 dispensed from the feeding end 7 of the magazine. Alternatively, an empty tube may be brought from the feeding end of the magazine to the ready position by a separate means. The longitudinal axis of the ready empty tube may be parallel to the axis 3 that runs between the flanges 2.

A lifting mechanism 11 is employed to lift an empty tube 8 from the ready position 13 to the winding mechanism 1. The lifting mechanism is a means to transfer the empty tube to the winding mechanism. It may comprise an arm 9 with a tube carrier 10. The tube carrier 10 may grip the empty tube, or it may comprise a hook or arms which lift the empty tube from below and in which the empty tube rests. It is an aspect of the invention that the ready position 13 is the position of an empty tube in a tube carrier when the lifting mechanism 11 is in the lower resting position.

The positional arrangement of the ready empty tube in the lifting mechanism 11 and the flanges 2 of the winding mechanism permit an upward movement by the lifting mechanism 11, sufficient to align the empty tube 8 with the flanges 2 of the winding mechanism 1. Preferably the arm 9 of the lifting mechanism 11 moves the tube carrier 10 in an arc 18 (FIG. 5), said arc essentially crossing the centre of the empty tube in the ready position 13 and the longitudinal axis of the flanges 2. The centre of the arc 16 is preferably located on the magazine 4. Preferably, winding arms 6 supporting the flanges 2 are positioned in such a way that the longitudinal axis of the flanges crosses the arc 18 (FIG. 5) moved by the center of the empty tube 8 in the tube carrier 10 of the lifting mechanism. Preferably, the ends of the empty tube 8 in the ready position 13 are situated between the flanges 2, so no horizontal (axial) translation is required by the arm of the lifting mechanism to align the ends of the empty tube with the flanges. The flanges 2 may move in an axial direction to grip the empty tube 8 presented by the lifting mechanism 11. The axial distance moved by the flanges 2 may be adjusted to allow a small or large error in the horizontal alignment of the components involved. E.g. the empty tube may be presented to the winding mechanism closer to one flange than the other, and axial movement by the flanges places the empty tube in the correct position for winding. The lifting mechanism may be configured to retract after the flanges have gripped the empty tube.

The tube carrier 10 of the lifting mechanism 11 moves upwards and downwards, in which case the empty tube in the ready position 13 is almost directly below the flanges 2 of the winding mechanism. However, in case the ready position is not directly below the flanges of the winding mechanism, the lifting mechanism may move the tube carrier in two or three dimensions, and about a rotational axis. Preferably the arm 9 of the lifting mechanism 11 moves the empty tube in the ready position 13 in an arc 18.

According to one aspect of the invention, a cycle of the lifting mechanism is moving the arm 9 and the empty tube in the ready position 13 to an upper position (FIG. 2) between the flanges. This movement brings the longitudinal axis of the empty tube 8 into alignment essentially with the longitudinal axis between the flanges 3. After the flanges have gripped the empty tube, the arm 9 and tube carrier 10 are returned back to a lower resting position beneath the ready position 13 of the empty tube.

For an economical construction, the lifting mechanism 11 may move the empty tube essentially vertically (e.g. in an arc) only. Furthermore, the distance moved may be fixed in an economical construction. The lifting mechanism may comprise a means (e.g. 12) to adjust the upper position of the empty tube in the tube carrier, for example, when the distance moved by the lifting mechanism is fixed. Such means 12 raises or lowers the empty tube 8 which is presented to the flanges 2. Said raising or lowering means 12 may take the form of an arm or tube carrier extender or reducer, or an adjustable screw thread in the arm or tube carrier. When the empty tube has a small diameter, thus, the means effectively increases the reach of the lifting mechanism to align the longitudinal ends of the empty tube with the flanges. Similarly where the empty tube has a large diameter, the means decreases the effective reach of the lifting mechanism to align the longitudinal ends of the empty tube with the flanges.

Figure 2:
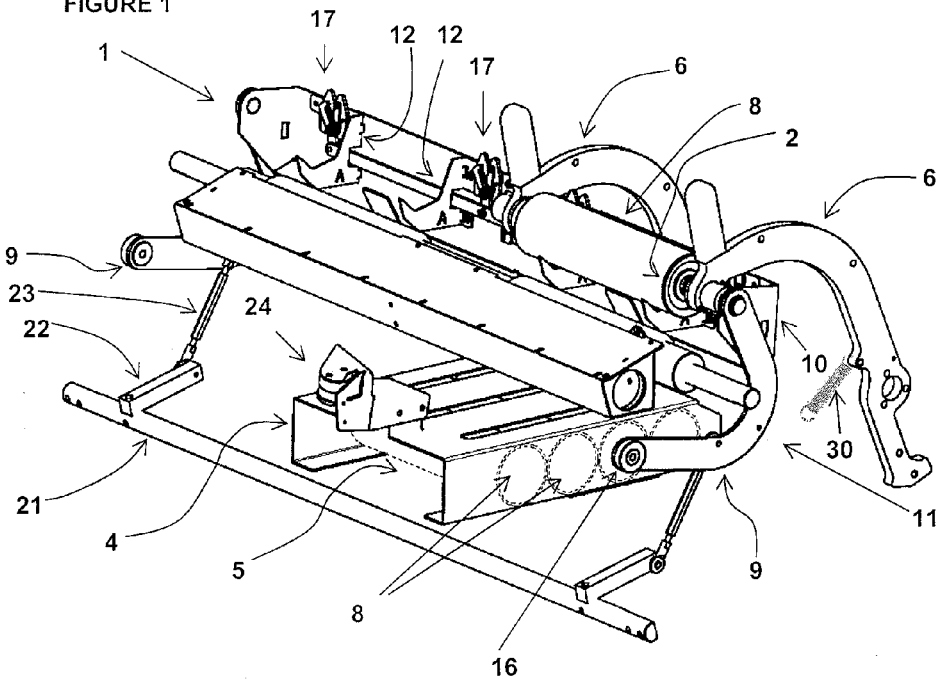
FIG. 2: Schematic figure of the winding station as shown in FIG. 1, wherein the arms of the lifting mechanism are resting in the upper position, and the winding arms are in the doffing position (i.e. have ejected a package).

Once the yarn has been wound onto the tube, the completed package or bobbin is ejected from the winding mechanism by a backward movement of pivoted winding arms 6 away from the winding mechanism i.e. the winding arms 6 move into a doffing position (see FIG. 2). The doffing position may coincide with the position where a new empty tube is introduced between the flanges by the tube carrier 10.

The lifting mechanism may comprise additional components to effect the movement of the arm such as, for example, a plurality of levers, pistons, rack-and-pinion assemblies, electric motors, etc. In one embodiment of the invention, the lifting mechanism comprises a lever arrangement as shown in FIGS. 1 and 2 which transmit rotational movement of a bar 21 via two levers 22, 23 to the arm 9 of the lifting mechanism. Such arrangement allows several bars 21 to be joined in a winding assembly of side-by-side winding machines, and powered by a single source of rotation.

The yarn traverse guide is normally inherently present in a winding station. It is a device which guides the supplied yarn to the package such that the package is wound evenly along its longitudinal axis. It generally comprises a thread guide which moves the yarn back and forth along the length of the package.

A problem in the art is 'losing' the trailing yarn of the wound package during the winding, for example when the yarn breaks or the supply of yarn runs out. Another aspect of the present invention, therefore, is a device to capture the trailing end of a package comprising a stationary vacuum enclosure 15 shaped to enclose the yarn across the range of its movements. A slot 20 is provided in the vacuum enclosure for the passage of yarn to a package. One or more tubes 19 may be connected to the enclosure, configured to direct yarn from the supply to the enclosure or vice versa, and for the application of suction to the enclosure.

Suction may be applied to the vacuum enclosure when there is a need to capture the trailing yarn of the wound package. Such feature is useful when the yarn accidentally breaks and has to be rejoined with the supply of yarn. In such case, the trailing yarn of the wound package can be captured by suction for automatic or manual knotting or splicing with the supply. It is also useful when the supply of yarn ends during the winding of a package. In such case, the trailing yarn of the wound package can be captured for automatic or manual knotting or splicing when the new supply is brought.

Another embodiment of the present invention is a winding station as disclosed herein, wherein the tube carrier 10 of the lifting mechanism 11 is disposed with one of more cutting mechanisms 17. When a wound package needs to be replaced by an empty tube, the yarn is brought to the side of the winding mechanism by means of the yarn traverse guide or other mechanism. A cutting mechanism 17 grabs the yarn when the tube carrier is moving towards or is positioned at the flanges 2 and cuts the supply yarn from the fully wound package. By placing a cutting mechanism on the tube carrier, the supply of yarn is cut proximal to the body of the lifted empty tube 8. Thus, the free-end of the supply of yarn is brought to the lifted empty tube at the start of winding. The cutting mechanism 17, therefore, doubles as a mechanism for introducing the free yarn to the empty tube 8 at the start of the winding. Such arrangement reduces the number of components necessary for aligning the free-end of the yarn supply with the empty tube.

It is a further aspect of the invention that a cutting mechanism 17 is positioned on the lifting mechanism (e.g. on the tube carrier 10) so it is aligned proximal to one or both ends of the lifted empty tube. Such arrangement permits an option to wind the package starting from the left or right hand side of the empty tube. For example, if the yarn supply is cut using a knife position at the left hand side of the empty tube, the package may be wound starting from the left hand side. This arrangement allows economical and flexible production of so called P or Q packages with the same winding mechanism.

Because the empty tube is lifted from below, and the full package ejected through the back of the winding station, there exists a continuous line of straight thread of yarn at a certain moment between the complete package and the yarn source, which straight thread of yarn is touched by an empty tube 8. This arrangement means the cutting mechanism 17 described above can cut the yarn so that the one trailing end cleanly leaves with the full package, and the other trailing end is positioned over one flange 2, to be gripped between said flange 2 the empty tube 8 so no slippage of said trailing end arises while winding commences. This arrangement solves elegantly the problem of cutting the yarn from the finished package, starting a new winding without slippage, all using a minimum of additional moving parts.

Figure 3:
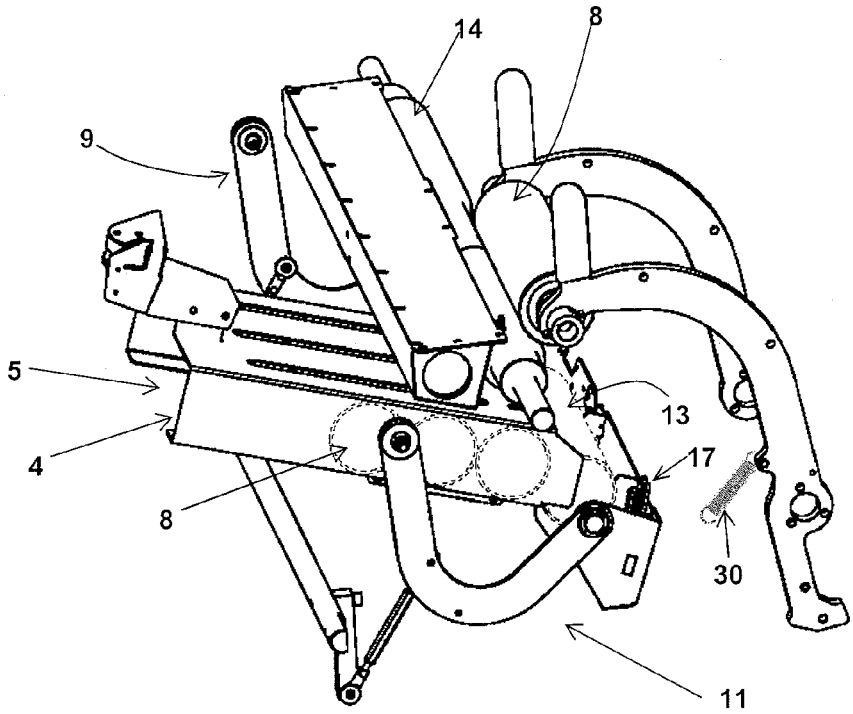
FIG. 3: Schematic figure of the winding station as shown in FIG. 1, from an alternative angle.

A winding station of the present invention can be incorporated into a winding assembly comprising more than one winding station. Because many of the components of a winding station rotate about axes that run from the left to the right of a station, the possibility arises to incorporate a plurality of winding stations, with aligned axes, side by side. These axes can be connected and driven by a single source of rotation, such as an electric motor. This has the advantage of easy maintenance since only a single source of rotation is maintained, rather than a plurality. In FIGS. 1 to 3, two winding stations share a common lifting mechanism 11. It is, therefore, within the scope of the invention that a winding assembly comprises a plurality of side-by-side stations which mechanisms are at least partially shared by 2, 3, 4, 5 or more winding stations.

It is also an aspect of the invention that a winding assembly comprises more than one winding station, stacked in a vertical direction. Because the magazine is placed below the winding mechanism, the winding station has a low profile. Therefore, winding stations can be stacked in a vertical direction with little loss of stability and easy access by the operator.

Examples of configurations of winding assemblies are 2, 3, 4, 5, 6, 7, 8, 9, 10 or more side by side winding station and 1, 2, 3 or 4 rows of vertically stacked winding stations.

The modular nature of the winding assembly means a bank of winders can be easily delivered and assembled at the site of the installation. Previously, a bank of winders would need to be assembled and aligned at the site of manufacture. By using a modular system having identical parts and components, such modules can be readily transported, and a skilled technician can easily put together a winding assembly quickly, so saving overall production costs. Furthermore, additional winding stations can be added or taken away according to the need of the user.

The present invention also relates to a method for winding on empty tubes stored in a magazine using a winding mechanism comprising:

lifting an empty tube from the feeding end of the magazine to the winding mechanism, said movement being in an upward direction, winding on the empty tube from a supply of yarn, and removing the wound package.

The method described herein may comprise one or more of features described above and in the Figures for the device.

A method according to the present invention may further comprises the step of lifting the empty tube with a lifting mechanism disposed with a cutting mechanism, said mechanism cutting the yarn from the supply. It is a further aspect that the yarn is held by the cutting mechanism before cutting.

It is an aspect of the method that the lifting of the empty tube from the feeding end of the magazine to the winding mechanism is an arc movement. Such movement permits the method to provide empty tubes of various diameters without substantial alteration or adjustment to the lifting mechanism.

The arrangement described above provides several advantages over the prior art. The feeding point 7 of the magazine 4 is brought close to the flanges 2 of the winding mechanism, unlike machines of the prior art where the production of packages with large diameters and/or accessibility by the operator or technician necessitate a higher distance between the magazine and flanges. Consequently, a small distance is traveled by the empty tube in the present invention, so increasing the speed of the operation, reliability, security and making a time and cost saving.

Furthermore, there is no necessity for the lifting mechanism to incorporate a means to grip the empty tube body. The empty tube is lifted from the ready position by means of a suitably shaped tube carrier 10. This is contrary to the prior art where the ready empty tube is brought to the winding mechanism by means of a grip. The consequence is a simpler and more economical design of the present invention.

The present invention permits construction of much lower (smaller) winding stations. As a result, transport costs are reduced, the machines are more stable. Furthermore, the design permits winding mechanisms to be stacked with little risk of instability.

Because the empty tube moves from the base upwards, the lifting mechanism can be used to "catch" the yarn into the cutting knife. Owing to this, the reliability of the doffing cycle is enhanced. These cutting knives are located close to the package so that the yarn can be cut off very near to the empty package.

Because the magazine is positioned below and very close to the winding mechanism, the magazine can be used as a solid support to fasten additional components related to the yarn path, such as the vacuum enclosure 15 or the "yarn guide—turning roller—knot catcher" assembly 24.

DETAILED DESCRIPTION OF THE FIGURES

FIG. 1: Schematic figure of a winding station according to the present invention comprising a winding mechanism 1, in which two flanges 2 flank the longitudinal axis of a space 3, for receiving an empty tube 8. Each flange 2 is mounted on a pivoted winding arm 6, which positions the flanges 2 so that an empty tube rests on the driving roller 14, such that the longitudinal axis of the empty tube 8 is above the longitudinal axis of the driving roller 14. The pivot 25 of the winding arms 6 is below the level of the axis 3 between the flanges 2. The distance of the flanges 2 with respect to the feeding end 7 of the magazine 4 can be adjusted by means of a pair of arms 6. Close below the winding mechanism 1 lies a magazine 4 for holding empty tubes 8. The magazine comprises a filling end 5 and a feeding end 7. The winding station further comprises a lifting mechanism 11, having a pair of arms 9 which control the movement of a tube carrier 10. The tube carrier comprises one or more cutting mechanisms 17 which can grip and cut the supply of yarn when the tube carrier is moving towards the flanges 2. When the tube carrier 10 is in the lower resting position (shown), the feeding end 7 of the magazine 4 is positioned slightly higher than the tube carrier 10, allowing an empty tube 8 to roll into the tube carrier 10 under the influence of gravity.

FIG. 2: Schematic figure of the winding station as shown in FIG. 1, wherein the arms 9 of the lifting mechanism 11 are resting in the upper position, and the winding arms 6 are in the doffing position (i.e. have ejected a package). In this mode, the tube carrier brings an empty tube 8 into position between the two flanges 2 of the winding mechanism 1. The adjusting means 12, is indicated on the adjoining empty tube carrier, which is a pair of interchangeable brackets that fine-tune the position of the lifted empty tube 8 between the flanges 2.

FIG. 3: Schematic figure of the winding station as shown in FIG. 1, from an alternative angle. Clearly shown is an empty tube in the ready position 13, held in the tube carrier of the lifting mechanism 11 in the lower resting position. Also depicted is the driving roller 14 that supports and drives the yarn package during the winding process.

Figure 4:
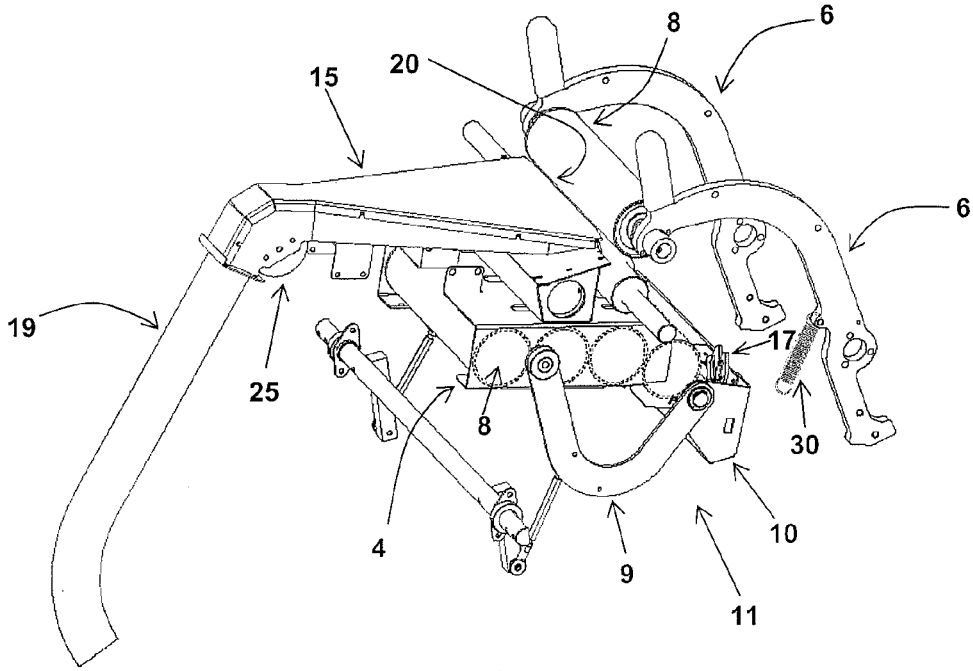
FIG. 4: Schematic figure of the winding station as shown in FIG. 1, from an alternative angle, and disposed with a stationary vacuum enclosure.

FIG. 4: Schematic figure of the winding station as shown in FIG. 1, from an alternative angle, and disposed with a stationary vacuum enclosure 15. During the winding process, the wound yarn is continuously inside the vacuum enclosure 15, entering said enclosure by means of a turning roll 26 and leaves the enclosure through a slot 20. Air is evacuated from the vacuum enclosure through a tube 19.

Figure 5:
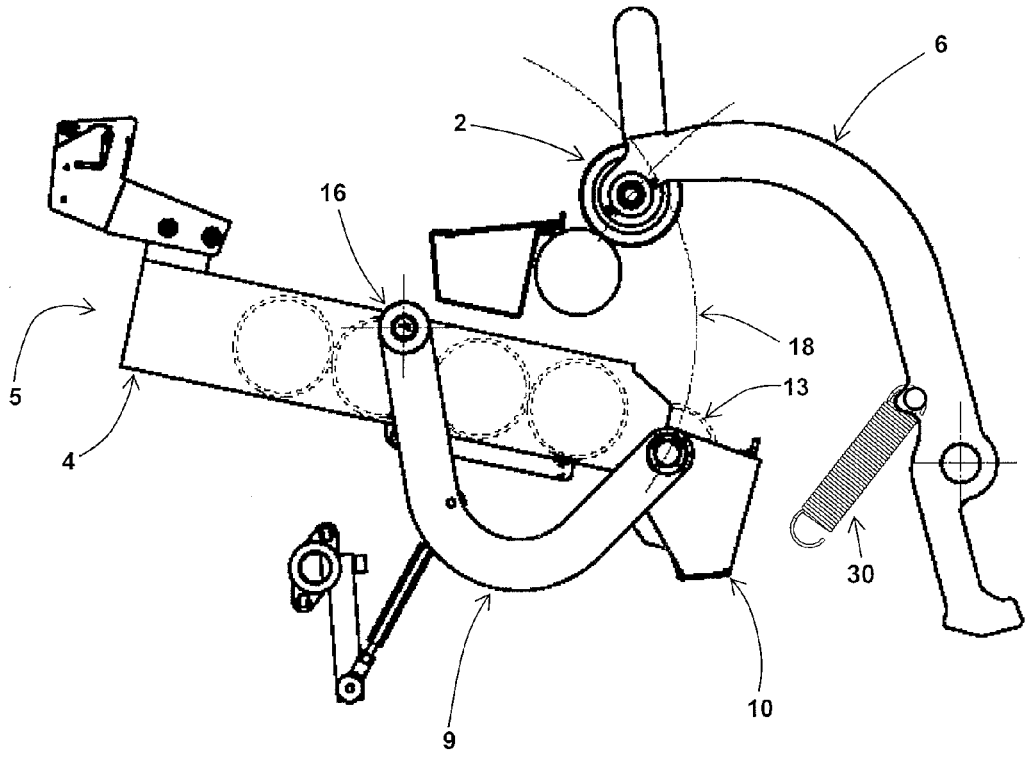
FIG. 5: Schematic figure of the winding station as shown in FIG. 1, shown in side view.
Figure 6:
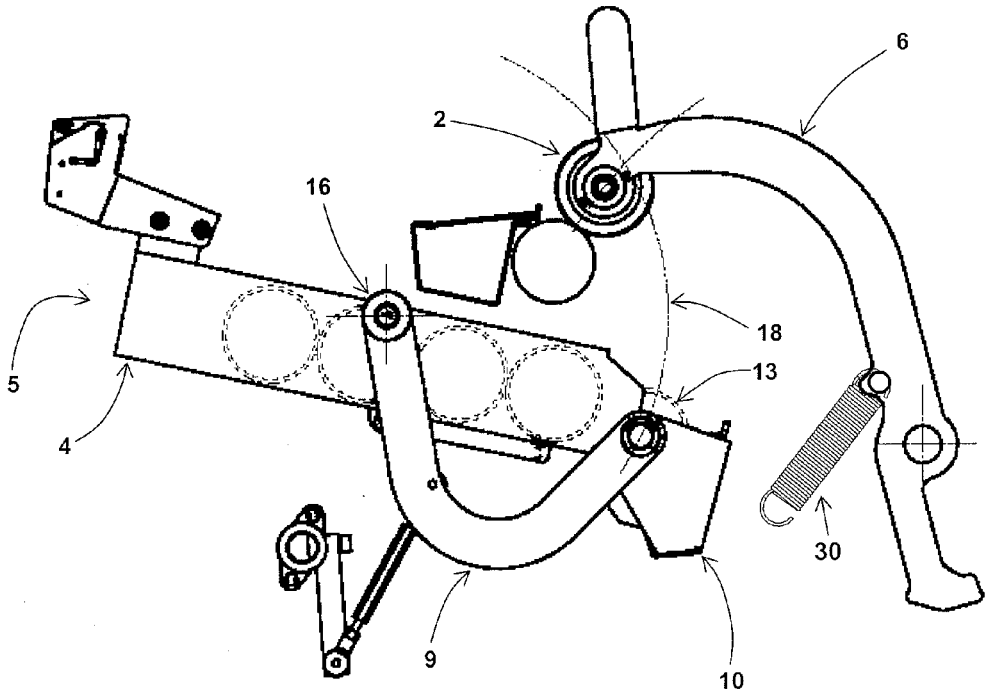
FIG. 6. Schematic figure of two of the winding stations of FIG. 5 shown stacked in side view.
Figure 6:
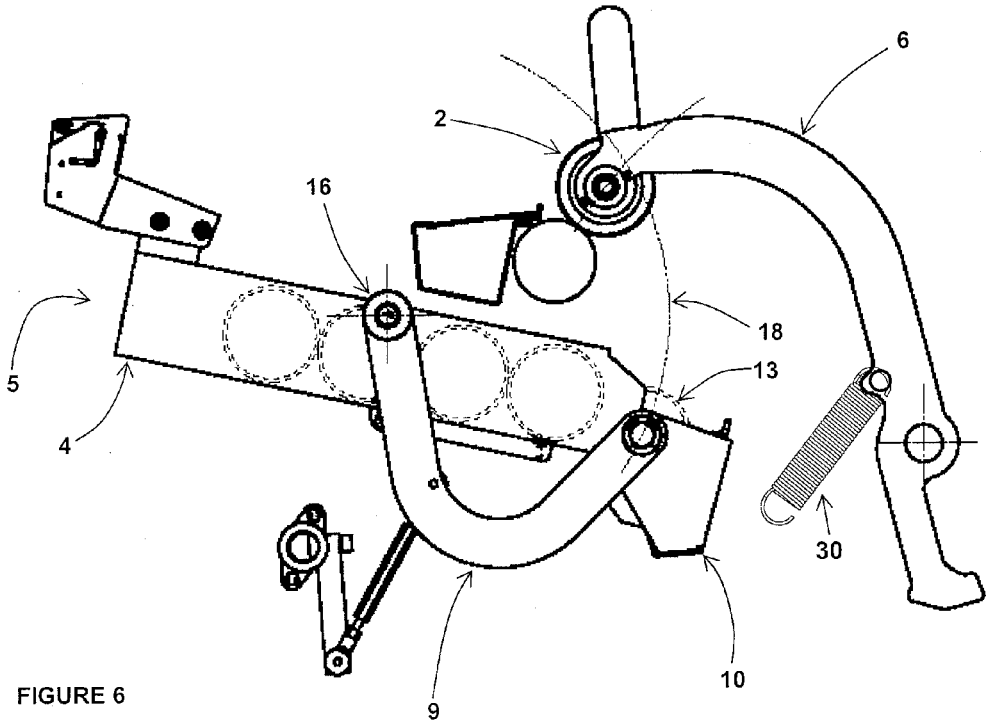

FIG. 5: Schematic figure of the winding station as shown in FIG. 1, shown in side view. Depicted is the arc 18 moved by the center of the empty tube 8 in the tube carrier 10 which bisects the arc moved by the longitudinal axis of the two flanges 2. Also shown are the angle of the magazine, alpha, compared with the horizon, and a line of feeding yarn 28.

What is claimed is:

1. A winding station for winding textile yarn onto empty tubes, comprising:

a winding mechanism comprising two flanges for gripping the ends of said tube, each flange mounted on a pivoted winding arm, which arms position the empty tube in contact with a driving roller, such that the longitudinal axis of the empty tube is above the longitudinal axis of the driving roller, a stationary, linear magazine with a filling end and a feeding end, wherein the filling end and the feeding end of the magazine are below the level of the flanges, and the filling end is above the feeding end such that the magazine is inclined at an angle, alpha, of less than or equal to 45 deg, a lifting mechanism comprising a pivoted arm provided with a pivot point, which arm terminates in a tube carrier, which tube carrier is configured to bring an empty tube from the feeding end of the magazine to a space between the flanges by an arc movement of the arm around the pivot point when said flanges are in a doffing position, wherein the longitudinal axis of the empty tube is above the longitudinal axis of the driving roller so that sufficient pressure between the tube and driving roller for winding is provided by the force of gravity.

2. The winding station according to claim 1, wherein said winding arms are configured to move in a direction away from the filling end of the magazine to eject the completed package, so providing a linear workflow from the front to the back of the station.

3. The winding station according to claim 1, wherein the feeding end of the magazine is located close below the flanges, so that a movement - which distance is less than or equal to 4 times the outside diameter of an empty tube —by the tube carrier lifts an empty tube from a ready position at the mouth of the magazine to the space between the flanges when the winding arms are in a doffing position.

4. The winding station according to claim 1, wherein the tube carrier is disposed with one or more cutting mechanisms for cutting the supply of yarn from the fully wound package when the tube carrier is moving towards or located at the flanges.

5. The winding station according to claim 4 wherein said cutting mechanism is positioned on the tube carrier so it is aligned proximal to one or both ends of the lifted empty package.

6. The winding station according to claim 1, wherein the lifting mechanism is configured to return the tube carrier to the feeding end of the magazine after the flanges have gripped the empty tube.

7. The winding station according to claim 1, wherein the point of the pivot of the winding arms is below the longitudinal axis between the flanges.

8. The winding station according to claim 1, wherein the lifting mechanism further comprises an arm or tube support extender or reducer to adjust position of the lifted empty tube between the flanges.

9. The winding station according to claim 1, further comprising a vacuum enclosure that is at least partially enclosing the fed yarn during winding.

10. The winding station according to claim 1, wherein the pressure between the tube and driving roller for winding provided by the force of gravity is complemented by a light spring.

11. A winding assembly comprising two or more winding stations according to claim 1.

12. The winding assembly according to claim 11, wherein said stations are arrange side by side in the direction of the longitudinal axes of the empty tube.

13. The winding assembly according to claim 12, wherein one or more components having longitudinal axes are interconnected between two or more winding stations.

14. The winding assembly according to claim 11, wherein said stations are arranged vertically.

* * * * *